US005803153A

United States Patent [19]

Rohatgi

[11] Patent Number: 5,803,153

[45] Date of Patent: Sep. 8, 1998

[54] NONFERROUS CAST METAL MATRIX COMPOSITES

[76] Inventor: Pradeep K. Rohatgi, 4759 N. Marlborough Dr., Milwaukee, Wis. 53211

[21] Appl. No.: 702,869

[22] Filed: Aug. 26, 1996

Related U.S. Application Data

[63] Continuation-in-part of Ser. No. 506,605, Jul. 25, 1995, abandoned, which is a continuation of Ser. No. 246,081, May 19, 1994, abandoned.

[51] Int. Cl.[6] ..... B22D 19/14

[52] U.S. Cl. ..... 164/97; 164/100

[58] Field of Search ..... 164/97, 55.1, 57.1, 164/58.1, 75, 100

[56] References Cited

U.S. PATENT DOCUMENTS

| | | | |
|---|---|---|---|
| 1,374,509 | 4/1921 | Lomax | 164/57.1 X |
| 1,403,005 | 1/1922 | Bowers | 164/97 |
| 2,204,453 | 6/1940 | Siegert | 164/97 |
| 3,720,257 | 3/1973 | Beutler et al. | 164/75 |
| 3,916,979 | 11/1975 | DeGois et al. | 164/57.1 |
| 4,024,902 | 5/1977 | Baum | 164/97 |
| 4,034,464 | 7/1977 | Hetke | 164/58.1 X |
| 4,279,289 | 7/1981 | Ban et al. | 164/97 |
| 4,617,979 | 10/1986 | Suzuki et al. | 164/97 |
| 5,025,849 | 6/1991 | Karmarkar et al. | 164/97 |
| 5,186,234 | 2/1993 | Hammond et al. | 164/97 |
| 5,200,003 | 4/1993 | Rohatgi . | |
| 5,253,697 | 10/1993 | LaJoye et al. | 164/97 |
| 5,385,195 | 1/1995 | Bell et al. | 164/100 X |

FOREIGN PATENT DOCUMENTS

| | | | |
|---|---|---|---|
| 4112693 | 11/1991 | Germany | 164/97 |
| 59-76656 | 5/1984 | Japan | 164/97 |
| 60-9568 | 1/1985 | Japan | 164/97 |
| 60-21306 | 2/1985 | Japan | 164/97 |
| 1-254366 | 10/1989 | Japan | 164/97 |
| 1013080 | 4/1983 | U.S.S.R. | 164/97 |

*Primary Examiner*—J. Reed Batten, Jr.

[57] ABSTRACT

Inserts of powder compacts or metal matrix composite inserts in the form of rods, bars, plates, wires, wire mesh, ribbons, chaplets, mold coatings or machining chips are placed in the sprue, sprue basin, runner, or a mold in gate of a static sand mold. The molten metal stream partly or completely melts the inserts releasing the reinforcements which get mixed with the molten alloy streams to form the shaped casting of the composite.

2 Claims, No Drawings

NONFERROUS CAST METAL MATRIX COMPOSITES

This application is a continuation-in-part of application Ser. No. 08/506,605, filed Jul. 25, 1995, now abandoned, which in turn is a continuation of 08/246,081 filed May 19, 1994, now abandoned.

FIELD OF INVENTION

This invention relates nonporous cast metal matrix composites which are shaped by pouring of molten metals or alloys in molds.

SUMMARY OF THE INVENTION

The invention relates to cast metal matrix composites where the dispersoids or reinforcements are introduced in the matrix during the final stages or close to the final stages of pouring of melts in the molds to form cast shapes. The dispersoids or reinforcements in the form of particulates, fibers or whiskers are (a) added to the stream of the melt as it is poured into the mold or (b) placed in the mold in a loose bed or as mold coating, (c) placed in the form of a solid insert of a metal matrix composite (in the shape of a chaplet, wire, wire mesh, rod, machining chips, ribbons or plates) in the mold; the solid insert melts releasing the dispersoid or reinforcement to be incorporated in the casting, and the matrix alloy of the solid insert mixes or alloys with the matrix of the melt being poured. The invention covers both situations where the matrix alloy of the insert placed in the mold is either the same or is different than the melt being poured in the mold. The invention also covers situations where two streams of melt, one of which is a composite, are simultaneously poured in the mold; the two streams mix in the mold and produce a composite casting. The invention covers situations where the melt being poured is already a composite which gets further reinforced with particles or fibers or whiskers released by melting of the solid composite insert placed in the mold. The invention also covers situations where the metal matrix composite insert in the mold melts only partly or does not melt at all, and is incorporated into the casting as a result of solidification of the surrounding melt. The invention also covers situations where the inserts are placed either in certain locations in the mold to get selective reinforcement of the casting, or they are placed in such a manner as to get a uniform distribution of reinforcement in the casting.

This invention covers the formation of a copper alloy-graphite composite by placement of nickel coated graphite powder in either the sprue, runner, or mold and pouring a molten copper alloy into the mold. The advantages of the nickel coating are (1) it wets molten metal similar to copper; (2) it has a solubility in the molten metal like copper; (3) it is a permissible alloying element in the matrix. It is expected that similar excellent composite forming results will obtain from nickel coated reinforcements of alumina, silicon carbide, and other ceramic particles. It is further presumed that coatings of cobalt, zinc, lead and tin in place of nickel will produce satisfactory results.

This invention also includes the forming of selective reinforced surfaces which are composite layers by pouring into a steel mold a molten metal such as copper on a suitable coated powder such as nickel coated graphite powder which is placed on a bed of a porous fiber blanket such as kaowool.

The invention has been reduced to practice for making castings of several nonferrous metal matrix composites containing a variety of particulates and can be applied to any metal matrix composite. The advantage of the invention is that it reduces the problem of floatation or settling of particulate or fibrous reinforcements or dispersoids which are added in large melts in furnaces or ladles; the invention also reduces the problem of reaction between the matrix alloy melts and the reinforcements or dispersoids due to the short contact period when they are added in the final stages of the casting. The invention also reduces the problem of segregation of particulate or fibrous dispersoids or reinforcements which occurs during solidification of composite castings within a mold since the solid metal matrix composite inserts placed in the mold act as heat sinks and internal chills reducing the total solidification time and the degree of segregation. The solid composite inserts placed in the mold also decrease the degree of central shrinkage in ingot castings due to reduced amount of material which solidifies in the mold, leading to higher yields.

BACKGROUND OF THE INVENTION

In recent years considerable activity has occurred in the area of cast metal matrix composites, especially with nonferrous metals like aluminum, magnesium, nickel, zinc, lead, tin and copper as the matrix materials, and particles or fibers of materials like graphite, silicon carbide, silica, alumina, fly ash, boron carbide, titanium carbide, molybidsulphide, tungsten carbides, acting as a dispersoid or reinforcement. Generally the particulate reinforcements or dispersoids are added to these nonferrous matrices to enhance properties like stiffness, strength, antifriction properties, wear resistance, damping capacity, and machinability. The process to manufacture these composites generally involves stirring these particles in large baths of molten alloys and pouring the mixture of molten alloy and the solid reinforcement either into molds in foundries to produce shaped castings or into the form of ingots which are again remelted and poured into molds to produce shaped castings. In these processes the particles remain in contact with large melts for a long time and they either settle or float in the melt leading to nonuniformity in the quantity and their distribution between castings, and within a given casting. The floatation of particles like graphite in baths of aluminum-graphite composites is well known. Likewise settling of silicon carbide in aluminum silicon carbide melts is well known. In addition the large contact times between these particles and the melts during mixing in large melts and holding these melts for long periods sometimes leads to reactions between molten alloys and the reinforcements or dispersoids. Sometimes these reactions can reduce the properties of cast composites. For instance, molten aluminum can react with silicon carbide or graphite to produce aluminum carbide, which degrades the properties of composites.

The processes of present invention reduce the time of contact between the melts and the dispersoids or reinforcements, and the time available for their floatation or settling. The processes of present invention involve adding the dispersoids or reinforcements to molten alloys just before or while they are being poured into the molds to produce a casting. The final composite melt is formed within the mold and solidifies within the mold in a short time to give a shaped casting.

DETAILED DESCRIPTION OF PREFERRED EMBODIMENT

In the present invention the dispersoids or reinforcements can be added to the melt of the matrix while it is poured into the mold just prior to its solidification while forming a shaped casting or an ingot, thereby minimizing the time available for settling or floatation, or for reaction between the dispersoids or reinforcements and the melt.

The dispersoids or reinforcements can be added to the stream of molten matrix alloy as it is being poured in the mold. The dispersoids or reinforcements can be in the form of particles, whiskers or short fibers, and they can be injected into the stream of molten matrix alloy as it enters the mold. The reinforcements should have enough kinetic energy and wettability that they get transferred from the gaseous phase to molten alloy without breaking up the stream of molten metal as it enters the mold. In certain instances the reinforcements or dispersoids may have to be coated with materials like nickel or copper or certain oxides which wet the molten matrix alloy. In other instances, a suitable additive may have to be added to the matrix alloy melt to enhance its wettability with the dispersoid or reinforcement, and to break up the oxide film on the metal stream to facilitate the entry of the particle or reinforcement into the stream.

A second form of this invention could be when a stream of molten composite master alloy containing very high percentage of dispersoids or reinforcements is poured into the mold along with the stream of molten matrix alloy; the two streams mix in the mold and the reinforcements or dispersoids get distributed in the entire casting.

Another form of process of this invention could be placement of reinforcement or dispersoid in a loose or compacted form either in the mold or at the base of the sprue through which molten matrix alloy is poured. Alternately the dispersoid or reinforcement can be placed in the form of coating on the surface of sprue, runner or the mold, which releases them into the melt as it is poured into the mold. The reinforcement or dispersoid would get mixed into the matrix alloy melt as it falls to the base of the sprue or enters the mold. In certain instances the reinforcements or dispersoids may have to be coated with materials like nickel or copper or selected oxides to enhance their wettability with the melt. In other instances, certain substances may be added to the melt to enhance its wettability with the reinforcements or dispersoids and to break up the oxide film on the surface of molten metal facilitating the transfer of particles in fibers or whiskers in the melt.

A fourth form of practice of this invention could be where solid inserts consisting of compacts of metal and ceramic powders or an already made metal matrix composite are placed in the sprue basin, or the runner or inside the mold cavity itself. These inserts melt when they come in contact with the molten metal being poured in the mold, and during melting the reinforcements are released and they get mixed with the entire metal in the mold. Generally the insert could be a metal matrix composite with the same matrix as the molten metal being poured, and containing very high volume percentage of reinforcements or dispersoids. Under certain preferred conditions, the superheat in the melt, the composition and size of inserts can be controlled in a manner that the matrix of the insert totally melts due to the superheat in the melt being poured in the mold, and mixes with the melt being poured; the dispersoids or reinforcements are released as a result of the melting of the matrix of the insert and they get mixed with the metal filling the mold.

In certain cases the insert can be of a matrix metal different than the melt being poured. In such cases the matrix of the insert should be preferably lower in melting point than the melt being poured and it should readily dissolve and mix in the melt being poured so as to avoid inhomogeneity in the matrix. The insert can be placed at the sprue basin, in the runner or in the mold where they melt and release the dispersoids or reinforcements as a result of control of melt superheat and size and composition of inserts.

In some cases it is not necessary for the metal matrix composite insert placed in the sprue or runner or the mold to completely melt. The melt composition and superheat, and the size and composition of the insert is controlled in a manner that the insert melts only partly, and the unmelted part becomes a part of the casting due to solidification of surrounding melt. In other cases the melts and inserts may be designed in such a manner that the inserts may not melt at all and become part of the casting due to solidification of she metal around it. In the latter case if the melt poured is a monolithic metal or alloy, the final casting will be selectively reinforced; if the melt poured is itself a composite it can solidify around the composite insert. Even when the metal matrix composite insert does not melt, it acts as an internal chill reducing the floatation or settling of the reinforcement during solidification of the melt in the mold.

The composite inserts can be in the form of pressed and/or sintered mixtures, metal or alloy powders and particles or fibers of reinforcements, or they can be cast or wrought metal matrix composites in the form of rods, ribbon, plates, wire or wire mesh, or chaplets. In certain cases the machining chips of metal matrix composites can also be used as inserts. Any of these forms of insert can melt and release the reinforcements in the mold, or in the sprue or runner region from where they can be carried into the mold along with the melt filling the mold.

Some of the preferred embodiments can be as follows.

A preferred embodiment can be a process for making a cast metal matrix composite where the reinforcement or dispersoids are introduced in the form of a powder, compact or metal matrix composite insert in the form of powder, machining chips, wire, wire meshes, rod, ribbon, chaplet, or plate which completely melts when the molten metal is poured in the mold releasing the dispersoids in the casting. The matrix metal or alloy of the composite insert placed in the mold can be either the same as the metal being poured or a different metal or alloy which readily alloys with the metal or alloy being poured. The inserts can be placed only in selected locations of the mold to get selective reinforcement of the casting or they can be placed uniformly to get a uniform distribution of reinforcement in the casting.

A preferred embodiment can be a process for making cast metal matrix composite components where the reinforcements or dispersoids are placed in the sprue or the runner or in the mold cavity in the form of a metal matrix composite insert in the form of powder, machining chips, wire, wire mesh, rod, ribbon, chaplet, or plate which only partly melt when the molten metal is poured in the mold, releasing the reinforcements or the dispersoids in the casting, and the unmelted composite insert becomes part of the casting formed by solidification of molten alloy around the unmelted insert.

A preferred embodiment can be a process for making cast metal matrix composite components where the reinforcements or dispersed phases can be introduced in the form of a metal matrix composite insert placed in the mold in the form of powder, machining chips, wire, wire mesh, rod, ribbon, chaplet, or plate which does not melt, but only gets incorporated into the casting as a result of solidification of the molten alloy around the insert.

Another preferred embodiment can be a process where the melt being poured into the mold consists of aluminum, magnesium, zinc, copper, lead, tin or their alloys, and the composite inserts placed in the mold have the same matrix metal; for instance, aluminum-graphite to release graphite in aluminum casting; copper-graphite to release graphite in copper casting; zinc-graphite to release graphite in zinc castings; lead-graphite to release graphite in lead castings; tin-graphite to release graphite in tin; magnesium graphite to release graphite in magnesium castings. Or the insert could be aluminum fly ash to release fly ash in aluminum casting, copper-fly ash to release fly ash in copper casting, zinc fly ash to release zinc in zinc casting.

Another preferred embodiment can be a process where the melt poured into the mold includes aluminum, copper, zinc, lead, tin, magnesium, or their alloys or composites, and the solid composite inserts placed in the mold have a matrix of a metal or alloy different than the melt being poured. The melt temperature and composition and the size distribution and composition of the inserts is controlled in such a manner matrix of the solid composite insert melts, and releases the dispersoid in the casting, and the matrix metal of the solid insert alloys with the molten metal being poured into the mold. When the melt being poured into the mold is also a composite the final casting will have dispersoids which were transported with the melt as well as those which were released by the insert.

Another preferred embodiment can be a process for making casting metal matrix composite shapes where the melt of a composite containing high volume fractions of reinforcements or dispersoids is poured in the mold along with the stream of molten matrix alloy. The two streams mix in the mold diluting the concentration of reinforcement or dispersoid and distributing it uniformly in the mold, resulting in a shaped casting of metal matrix composite.

In the practice of this invention to form metal matrix composites the best mode is to coat the reinforcing particles located in the runner, sprue, or mold before pouring. Such coating improves the wettability of the molten metal.

SPECIFIC EXAMPLES

Example 1

A two inch diameter six inch high sand mold was made and a melt of aluminum 12 silicon-5 graphite particle composite alloy was poured at 1200° F. in the mold. After solidification, the casting was sectioned and it showed floatation of graphite near the top of the casting and a shrinkage cavity at the top. In the next experiment, a 0.15" diameter rod of aluminum-12 silicon-5 graphite particle composite melt was placed in the center of the mold before the melt of the same alloy was poured in the mold at 300° C. superheat. The composite rod melted and the material mixed with the melt poured in the mold before its solidification. The casting produced in the second case showed reduced floatation of graphite. At lower superheats, the composite rod either melted only partially or did not melt at all, and became part of the final casting of the composite; in these cases also improved distributions of graphite were observed in the casting due to the chilling action of the composite rod placed in the mold before pouring the melt in the mold.

Example 2

A 2" diameter, 2" high sand mold was made and 80 to 100 grams of chips of aluminum-30 volume percent graphite particle composite were placed at the bottom of the mold. A melt of yellow brass was prepared in a furnace brought to a temperature of 1100° C. and poured at 1050° C. into the mold over the aluminum-30 volume percent graphite chips.

The melt of yellow brass melted aluminum-graphite composite chips, and the graphite particles released from the aluminum-graphite due to its melting were incorporated in the casting, improving the machinability and friction properties of the casting.

Example 3

A 2" diameter×6" high sand mold was made and 100 grams of chips of copper-graphite particle composite were placed in the mold. Molten copper alloy with a superheat of 300° C. was poured on the chips of copper graphite alloy. The chips melted upon coming in contact with molten copper alloy and the graphite particles released were incorporated into the casting which solidified as a composite due to incorporation of graphite.

Nickel coated graphite powder (60% nickel, graphite size 45 micron) in the runner of a sand spiral fluidity mold and a copper alloy C 90300 (Cu-5Sn-5Zn) was poured in the mold. After the casting, the end of the spiral showed formation of the composite in which graphite particles were well dispersed and bonded to the matrix of the copper alloy. The experiment shows that following the above described process a composite can be produced with selective reinforcement.

I claim:

1. A process for producing a cast composite in a static sand mold having a sprue, a sprue basin, a runner, and a mold ingate system comprising: locating reinforcing means in at least one of said sprue, said sprue basin, said runner and said mold ingate system; pouring a molten nonferrous metal into said sand mold; and allowing the metal to cool and to solidify to produce a composite casting.

2. The process of claim 1 wherein said reinforcing materials are in the form of powder, powder compacts, machining chips, wire, wire mesh, rods, chaplets, ribbon, plate and mold coatings.

* * * * *